US006623571B1

(12) United States Patent
Gupta

(10) Patent No.: US 6,623,571 B1
(45) Date of Patent: Sep. 23, 2003

(54) METASTABLE ALUMINUM-TITANIUM MATERIALS

(75) Inventor: Manoj Gupta, Singapore (SG)

(73) Assignee: National University of Singapore, Singapore (SG)

( * ) Notice: Subject to any disclaimer, the term of this patent is extended or adjusted under 35 U.S.C. 154(b) by 0 days.

(21) Appl. No.: 09/762,104

(22) PCT Filed: Jul. 7, 1999

(86) PCT No.: PCT/SG99/00069

§ 371 (c)(1),
(2), (4) Date: Apr. 4, 2001

(87) PCT Pub. No.: WO00/08217

PCT Pub. Date: Feb. 17, 2000

(30) Foreign Application Priority Data

Aug. 4, 1998 (SG) ..... 9802748

(51) Int. Cl.[7] ..... C22C 21/00

(52) U.S. Cl. ..... 148/437; 148/337; 75/338; 164/46; 164/97

(58) Field of Search ..... 164/46, 97; 148/437, 148/337; 75/338, 684, 678; 427/422, 456

(56) References Cited

U.S. PATENT DOCUMENTS 3,837,894 A * 9/1974 Tucker, Jr. ..... 427/419.2
4,161,826 A * 7/1979 Hutta et al. ..... 34/389
4,674,554 A * 6/1987 Feest ..... 164/46
4,697,631 A * 10/1987 Bungeroth et al. ..... 164/459
4,847,047 A 7/1989 Groetsch, Jr. et al.
4,926,924 A * 5/1990 Brooks et al. ..... 118/312
5,494,541 A * 2/1996 Fujita et al. ..... 148/403
5,547,633 A * 8/1996 Muddle et al. ..... 148/415

FOREIGN PATENT DOCUMENTS

EP A2250811 1/1988

* cited by examiner

*Primary Examiner*—Roy King
*Assistant Examiner*—Andew Wessman
(74) *Attorney, Agent, or Firm*—Birch, Stewart, Kolasch & Birch, LLP

(57) ABSTRACT

This invention relates to the synthesis of a new generation of metastable aluminum-titanium (Al—Ti) alloys and the process of making them. The preparation method used is a combination process incorporating the advantages of conventional casting and spray techniques. The process is a low cost process. The aluminum-titanium materials made in this invention contain titanium in both the reacted and unreacted form. The results were confirmed using microstructural and x-ray diffraction studies. The presence of phases clearly indicate the metastable nature of these materials in accordance with the equilibrium phase diagram established for Al—Ti system. The Al—Ti materials can be made in the dimensions suitable for structural applications at ambient and elevated temperatures and as control materials for synthesis of more dilute equilibrium Al—Ti materials using conventional techniques such as casting.

14 Claims, 2 Drawing Sheets

METASTABLE ALUMINUM-TITANIUM MATERIALS

Figure 1:
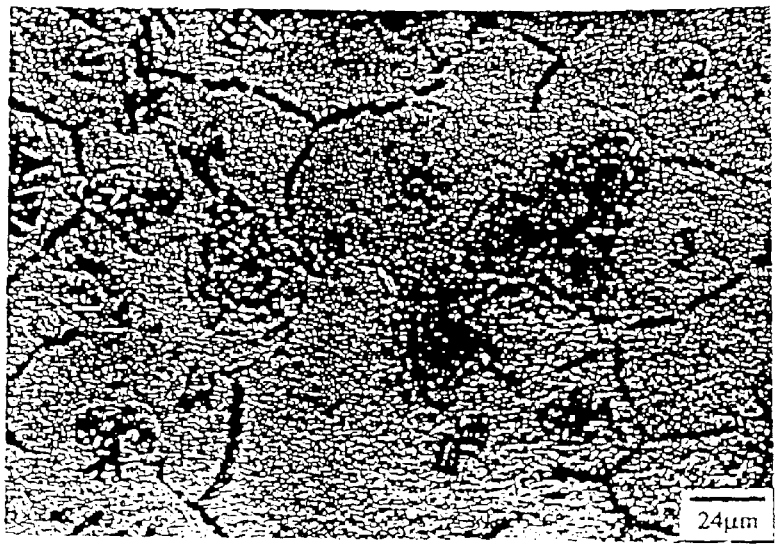

This application is the national phases under 35 U.S.C. §371 of PCT International Application No. PCT/SG99/00069 which has an International filing date of Jul. 7, 1999, which designated the United States of America.

The present invention relates to metastable aluminium-titanium materials and to a process for their manufacture.

In recent times the continuing and rapid advancement in technology has led to the design and development of high performance devices capable of operating in increasingly hostile service conditions. From the existing trend in the technological development it can be anticipated that the severity of the service conditions that these devices will have to withstand will increase in the time to come. One of the important criterion to realize the continuing improvement in the efficiency of these devices is the development of materials that will be used to make these devices and their ability to withstand increasingly hostile service conditions. Aluminium alloys with titanium as the main alloying element are one such class of materials actively pursued for possible application in relatively high temperature and high stress conditions.

The use of titanium in aluminium has been explored as an alloying element so as to synthesize high performance materials for advanced engineering applications. Processing techniques based on molten metals (such as conventional casting and spray atomization and deposition) and metallic powders (such as powder metallurgy and mechanical alloying) have been investigated. Amongst these techniques, the synthesis of aluminium-titanium materials can be carried out more cost effectively by the methods based on molten metals. The studies conducted so far have shown that the addition of titanium in the liquid aluminium leads to: a) an increase in the melting temperature of aluminium significantly and b) reaction between titanium and aluminium to form $Al_3Ti$ through peritectic reaction. For example, addition of 10 weight percent of titanium in aluminium raises the melting point of aluminium from ~660° C. to ~1200° C. besides significantly increasing the chemical reactivity of the resultant molten Al—Ti mixture. This necessitates the use of more expensive and specialised furnaces (such as induction furnace) capable of heating to higher temperatures and crucibles made of highly inert materials thus increasing the overall cost of synthesis material. The interaction between titanium and aluminium in the molten condition results in either a solid solution of titanium in aluminium (with very limited solid solubility) or the formation of $Al_3Ti$ through peritectic reaction or primary solidification. The microstructures of aluminium-titanium synthesized using conventional casting with slow cooling rate and spray atomization and deposition with reasonably high cooling rates (~$10^{3-4}$ K/s) revealed the as-expected existence of $Al_3Ti$ intermetallic phase and equilibrium/extended solid solubility of titanium in aluminium. Neither of these techniques has shown the capability of synthesizing aluminium-titanium materials at temperatures lower than that exhibited by equilibrium Al—Ti phase diagram and in retaining the titanium as titanium in its elemental form following solidification by controlling the reaction between the molten aluminium and titanium.

We have now found a process for producing metastable aluminium-titanium materials which may be successfully produced at temperatures lower than those required by the equilibrium Al—Ti phase diagram. The metastable aluminium-titanium materials have been produced by controlling the reaction of the titanium with the molten aluminium in order to retain a proportion of the titanium in its elemental form.

According to the present invention there is provided a process for the manufacture of a metastable aluminium-titanium material comprising the steps of:

i) melting aluminium in a crucible;

ii) mixing solid particulate titanium with the molten aluminium; and iii) disintegrating or spraying the molten mixture on a metallic substrate such that the molten mixture is deposited and solidified on the metallic substrate, and wherein at least a substantial portion of the titanium is retained as elemental titanium after the molten mixture is solidified on the metallic substrate.

There is also provided a metastable aluminium-titanium material manufactured by the process described in the immediately preceding paragraph.

It will be understood that by the term "at least a substantial portion of the titanium is retained as elemental titanium" it is meant that sufficient elemental titanium is present in the metastable titanium material to strengthen the aluminium matrix. The presence of titanium in the matrix advantageously serves to improve the mechanical behaviour of the aluminium at ambient and elevated temperatures as a result of its high melting point, strength and modulus properties. If not for the presence of metastable titanium in the matrix and associated metastable strengthening, the synthesis requirement for conventional Al—Ti alloys with similar amounts of titanium in the form of precipitates or in solid solution will necessitate a much more complex combination of melting process (skull melting), furnaces (induction furnace), crucible (titanium) and superheating temperatures. As an example, synthesis of Al with 10 wt. % Ti will require a superheat temperature of ~1200° C. when compared to 750° C. using the presently described process. It is preferred that the elemental titanium retained in the metastable aluminium-titanium material is present in an amount ranging up to 20% by weight of the material.

It is preferred that the retained elemental titanium in the particulate form is uniformly distributed throughout the material. The uniform distribution indicates a non-aligned and non-clustered (as much as possible) distribution in three directions (an isotropic distribution).

In a preferred embodiment, the mixture of molten aluminium and particulate titanium is poured or allowed to flow from the crucible, and is subsequently disintegrated using jets of inert gas, the spray from the disintegrated mixture being deposited and solidified on the metallic substrate.

The at least a substantial portion of the titanium may be retained as elemental titanium by controlling the exposure time of the titanium to the molten aluminium. The period will be readily determined by simple experimentation having regard to the temperature of the aluminium to which the titanium is exposed and the particle size of the solid particulate titanium. The lower the temperature of the molten aluminium, the longer the treatment period which the titanium may be exposed to the hot aluminium. The larger the particulate size of the solid particulate titanium, the longer the treatment period which the titanium may be exposed to hot aluminium. The emphasis however is to advantageously minimize the exposure time of the particulate titanium to the molten aluminium so as to avoid undesirable reactions between the two and to enhance the retention of the elemental titanium by aluminium following solidification.

The solid particulate titanium may alternatively or additionally be treated prior to mixing with the molten aluminium in order to increase the period the titanium may be exposed to the hot aluminium and to enhance the retention of elemental titanium in aluminium following solidification. For example, the solid particulate titanium may be treated to produce an oxide coating thereupon so as to decrease the reactivity of the solid particulate titanium to the molten aluminium. Titanium powders may be preheated to temperatures in the range of from 600° C. to 815° C., preferably about 650° C. for a period of at least 30 minutes, preferably 1 hour in order to produce an oxide surface layer.

The present invention further provides a metastable aluminium-titanium material, of which a substantial portion of the titanium comprises solid particulate titanium which is substantially uniformly distributed throughout the aluminium.

The metastable aluminium-titanium material comprises the presence of nearly uniformly distributed elemental titanium particulates in a non-aligned and non-clustered form in all three directions, with minimal reaction with the aluminium based matrix. The materials do exhibit the presence of finite amount of Al—Ti based phases, and minimal amount of non-interconnected porosity. The presence of Al—Ti based phases is advantageously mostly confined to the near vicinity of the titanium particles.

Aluminium suitable for use as the matrix of the metastable aluminium-titanium materials include the aluminium based materials containing alloying additions such as copper, silicon, zinc, iron, magnesium either independently or in combination with each other.

Preferably the aluminium is treated prior to melting in order to eliminate surface impurities. A suitable method for treating the aluminium includes washing the aluminium with water and acetone.

In the process of the present invention the aluminium is melted in an inert crucible or other suitable container. The metal may, for example, be melted by resistance melting based techniques.

The molten aluminium is then held at a temperature for the blending of the solid particulate titanium. The superheat temperature is so selected so as to ensure the complete melting and sufficient fluidity of the molten metal so that it can be stirred easily and effectively.

The solid particulate titanium for use in the present invention preferably include ones with purity levels ≧99%. For the purpose of other than a binary Al—Ti system, the present methodology may incorporate any other titanium based particles in the size ranges containing average particle sizes of preferably <200 μm.

The solid particulate titanium may be combined with the molten metal by any convenient means. Typically the solid particulate ceramic material may be combined with the metallic metal by their additions while stirring the molten aluminium. The stirring is preferably done using a suitably designed stirrer being stirred in the speed range of 450 rpm–900 rpm and placed in the crucible below the surface of the melt. The stirrer design employed in the present study comprised a shaft having a length of about 24 cm and two blades pitched at about 45° to the vertical, and having a diameter of about 0.6 D, where D is the diameter of the melt at rest.

The mixed blend, following the addition of the titanium particles, is immediately poured or allowed to flow from the crucible.

The mixed blend poured from the crucible is then preferably disintegrated. The poured molten mixture is most preferably disintegrated using jets of inert gas. Suitable inert gases for use in disintegrating the poured molten mixture include argon, and nitrogen. The jets of inert gas are advantageously aligned at 90° to the axis of molten metal stream for best results. As a result of disintegration the stream of mixed blend is converted into a form of spray with the average droplet/splat size of about 180 μm. The resultant disintegrated mixture thus obtained is subsequently deposited into a metallic substrate. Typical metals used for substrate include iron and copper based materials. The process advantageously allows the substrate to be used at ambient temperature thus enabling to minimize the cost of the process. The Al—Ti materials can be made in the dimensions suitable for structural applications at ambient and elevated temperatures and as control materials for synthesis of more dilute equilibrium Al—Ti materials using conventional techniques such as casting.

Preforms produced by the process of the present invention are advantageously near fully dense and in a near final shape with the matrix having a fine grained equiaxed microstructure. The preforms may be produced in near final product form requiring minimal amounts of machining.

The metastable aluminium-titanium material produced according to the present invention at temperatures of about 750° C. are significantly lower than that predicted by the equilibrium phase diagram. The melting temperature of aluminium containing 6 weight percentage of titanium under equilibrium conditions will approach closely to 1100° C. and will hence require even higher temperatures (at least a 50° C. superheating) for processing through conventional molten metal methods. The material of the present invention retains titanium as elemental titanium in the microstructure following the solidification of aluminium. Furthermore, the low level of porosity which may be achieved indicates the feasibility of these methods to be used for near net shape synthesis. Finally, an increase in microhardness exhibited by aluminium-titanium materials synthesized using the present invention when compared to pure aluminium indicates that the presence of titanium in the aluminium matrix will favourably increase the mechanical properties of the resultant bulk aluminium-titanium material.

A more detailed description of the present invention is further described by the following non-limiting examples and accompanying drawings in which:

FIG. 1 Optical micrograph showing the presence of elemental titanium and the interfacial reaction zone in aluminium-titanium material synthesized using Method A.

Figure 2:
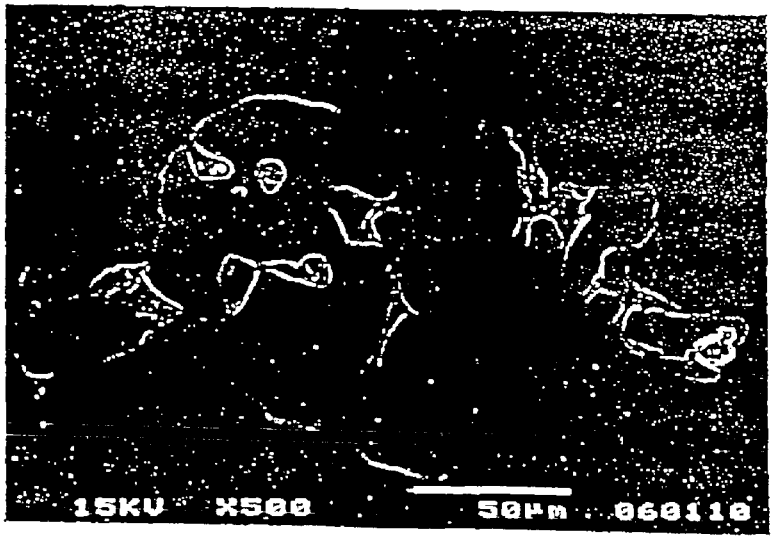

FIG. 2 Scanning Electron micrograph showing the presence of elemental titanium and a very narrow interfacial reaction zone in aluminium-titanium material synthesized using Method B.

Figure 3:
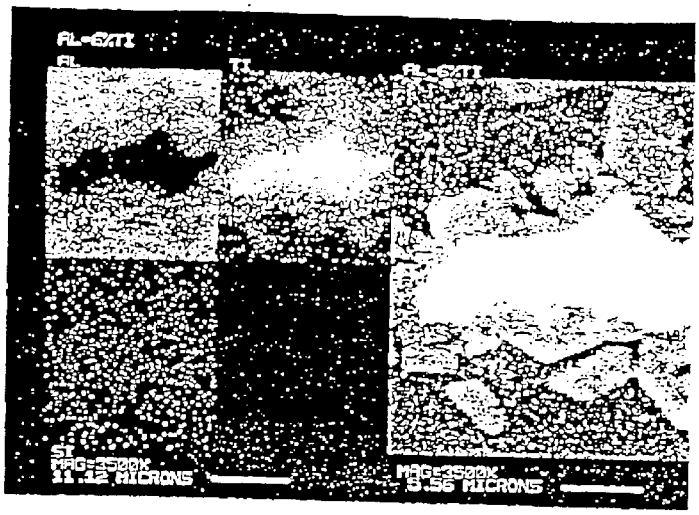

FIG. 3 EDAX mapping showing the evidence of presence of titanium and significant interfacial reaction zone in the case of aluminium-titanium material using Method A.

Figure 4:
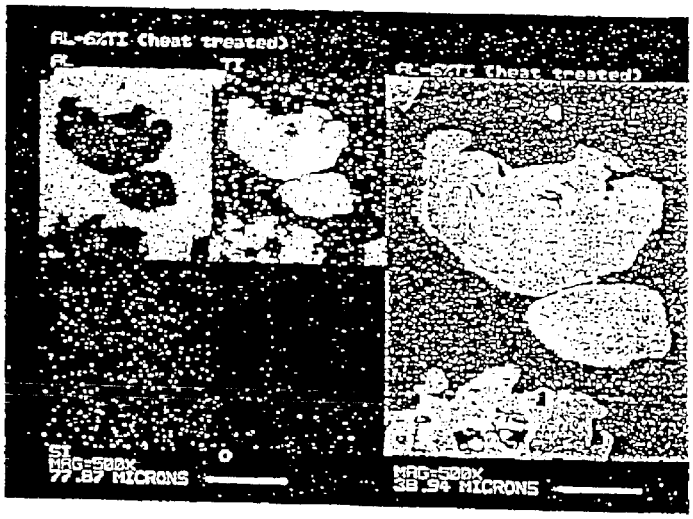

FIG. 4 EDAX mapping showing the evidence of presence of titanium and a very narrow interfacial reaction zone in the case of aluminium-titanium material synthesized using Method B.

EXAMPLES

Method A: Limiting Reaction Time Between Molten Aluminium and Titanium Powder The synthesis methodology of metastable aluminium-titanium material using Method A involved the following steps. Rectangular pieces of aluminium were cut and subsequently washed using water and acetone to remove the surface impurities. After weighing, the cleaned pieces were placed in graphite crucible and superheated to 750° C.

Titanium powders equivalent to 6 weight percent were added into the molten aluminium melt stirred using zirconia coated stirrer at 465 rpm. The total addition time of titanium powders was limited to not more than 3 minutes. The resultant slurry thus obtained in the crucible was allowed to flow into a 10 mm diameter stream through a centrally drilled hole in the crucible and was disintegrated using argon gas jets at a distance of ~255 mm from the pouring point and subsequently deposited onto a metallic substrate located at a distance of 715 mm.

Method B: Modifying the Surface Characteristics of the Titanium Powders

The synthesis methodology of metastable aluminium-titanium material using Method B involved the following steps. Rectangular pieces of aluminium were cut and subsequently washed using water and acetone to remove the surface impurities. After weighing, the cleaned pieces were placed in graphite crucible and superheated to 750° C. Titanium powders equivalent to 6 weight percent were heat treated at 650° C. for 1 hour in order to produce a surface oxide layer [6] and were subsequently added into the molten aluminium melt stirred using zirconia coated stirrer at 465 rpm. The confirmation of the formation of oxide layer on the titanium powders were made using the x-ray diffraction technique. The total addition time of titanium powders was limited to not more than 3 minutes. The resultant slurry thus obtained in the crucible was allowed to flow into a 10 mm diameter stream through a centrally drilled hole in the crucible and was disintegrated using argon gas jets at a distance of ~255 mm from the pouring point and subsequently deposited onto a metallic substrate located at a distance of 715 mm.

For comparison purposes aluminium was also synthesized using the processing parameters similar to those used in Methods A and B.

Metastable aluminium-titanium materials synthesized in the present study were characterized in terms of presence of elemental titanium, interfacial reactivity between aluminium matrix and titanium powders, porosity and microhardness of the metallic matrix. The presence of elemental titanium was confirmed using x-ray diffraction technique (see Table 1) and optical microscopy (see FIG. 1) which shows aluminium-titanium material produced using Method A. FIG. 2 shows a scanning electron micrograph of the aluminium-titanium material produced using Method B. The extent of interfacial reactivity was determined by x-ray area mapping using EDAX (see FIGS. 3-Method A and 4-Method B); porosity was determined using image analysis (see Table 2) and the microhardness measurements were made using an automated Matsuzawa Digital Microhardness Tester with a pryamidial diamond indenter using an indentation load of 50 g and a loading speed of 50 $\mu$m/s (see Table 2).

TABLE 1

Results of X-ray diffraction showing the presence of elemental titanium and other selected phases in the case of aluminium-titanium materials synthesized using Methods A and B.

| | | Number of matching peaks | |
|---|---|---|---|
| Phases | Pure Aluminium | Al—Ti (Method A) | Al—Ti (Method B) |
| Al | 5 | 5 | 5 |
| Ti | — | 5 | 7 |

TABLE 1-continued

Results of X-ray diffraction showing the presence of elemental titanium and other selected phases in the case of aluminium-titanium materials synthesized using Methods A and B.

| | | Number of matching peaks | |
|---|---|---|---|
| Phases | Pure Aluminium | Al—Ti (Method A) | Al—Ti (Method B) |
| AlTi | — | 6 | 5 |
| $Al_2Ti$ | — | 6 | 5 |
| $Al_3Ti$ | — | 5 | 2 |

TABLE 2

Results of porosity and microhardness measurements conducted on pure aluminium and metastable aluminium-titanium materials.

| Property | Pure Aluminium | Al—Ti (Method A) | Al—Ti (Method B) |
|---|---|---|---|
| Porosity (%) | 1.1 | 0.3 | 3.2 |
| Microhardness (HV) | 32.0 ± 0.9 | 36.8 ± 0.5 | 35.0 ± 1.4 |

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Those skilled in the art will appreciate that the invention described herein is susceptible to variations and modifications other than those specifically described. It is to be understood that the invention includes all such variations and modifications which fall within its spirit and scope. The invention also includes all the steps, features, compositions and compounds referred to or indicated in this specification, individually or collectively, and any and all combinations of any two or more of said steps or features.

What is claimed is:

1. A process for the manufacture of a metastable aluminium-titanium material comprising the steps of:

i) melting aluminium in a crucible;

ii) mixing solid particulate titanium with the molten aluminium; and iii) disintegrating or spraying the molten mixture on a metallic substrate such that the molten mixture is deposited and solidified on the metallic substrate, and wherein at least a substantial portion of the titanium is retained as elemental titanium after the molten mixture is solidified on the metallic substrate.

2. A process according to claim 1, wherein in step (iii) the mixture of molten aluminium and particulate titanium is poured or allowed to flow from the crucible, and is subsequently disintegrated using jets of inert gas, the spray from the disintegrated mixture being deposited and solidified on the metallic substrate.

3. A process according to claim 1, wherein the at least a substantial portion of the titanium is retained as elemental titanium by controlling the exposure time of the titanium to the molten aluminium.

4. A process according to claim 1, wherein prior to mixing with the molten aluminium, the solid particulate titanium is treated to produce an oxide coating thereupon.

5. A process according to claim 4, wherein the solid particulate titanium is preheated to temperatures in the range of from 600° C. to 815° C. for a period of at least 30 minutes to produce a surface layer of minimal reactivity.

6. A process according to claim 4, wherein the solid particulate titanium is preheated to temperatures in the range of from 600° C. to 815° C. for a period of at least 30 minutes to produce an oxide surface layer of minimal reactivity.

7. A process according to claim 1 wherein, prior to melting, the aluntinium is treated to minimise surface impurities.

8. A process according to claim 7, wherein said treatment comprises washing the aluminium with water and acetone.

9. A process according to claim 1, wherein said aluminium is melted by a resistance melting based technique.

10. A process according to claim 1, wherein the metastable aluminium-titanium material contains a further component selected from the group consisting of copper, silicon, zinc, iron, magnesium and combinations thereof.

11. A process according to claim 1 wherein the solid particulate titanium comprises titanium based particles having an average particle size of <200 $\mu$m.

12. A metastable aluminum-titanium material produced by a method as defined in claim 1, said particulate titanium having an oxide layer, wherein said particulate titanium retained in said aluminum-titanium material is present in an amount of up to 20% by weight of the material, said particulate titanium having a purity of 99% or greater, and being uniformly distributed, non-aligned, and substantially non-clustered in each of three dimensions.

13. A preform produced by a process according to claim 1, wherein the preform comprises said aluminum-titanium material, said aluminum-titanium material having a grained equiaxed microstructure, wherein elemental titanium retained in said aluminum-titanium material is present in an amount of up to 20% by weight of the material, and is uniformly distributed, non-aligned, and substantially non-clustered in each of three dimensions.

14. A metastable aluminum-titanium material produced by a process according to claim 1, comprising solid elemental particulate titanium having an oxide layer thereon, said elemental particulate titanium being present in an amount of up to 20% by weight of the material, and being substantially uniformly distributed, non-aligned, and substantially non-clustered in each of three dimensions throughout the aluminum.

* * * * *